US009785067B2

(12) United States Patent
Kida

(10) Patent No.: US 9,785,067 B2
(45) **Date of Patent: *Oct. 10, 2017**

(54) ELECTROSTATIC LATENT IMAGE DEVELOPING TONER AND EXTERNAL ADDITIVE

(71) Applicant: KYOCERA Document Solutions Inc., Osaka (JP)

(72) Inventor: Yukari Kida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/195,234

(22) Filed: Jun. 28, 2016

(65) Prior Publication Data

US 2017/0003613 A1 Jan. 5, 2017

(30) Foreign Application Priority Data

Jun. 30, 2015 (JP) ..... 2015-131181

(51) Int. Cl.
*G03G 9/08* (2006.01)
*G03G 9/093* (2006.01)
*G03G 9/097* (2006.01)

(52) U.S. Cl.
CPC ..... *G03G 9/0825* (2013.01); *G03G 9/09307* (2013.01); *G03G 9/09708* (2013.01); *G03G 9/09733* (2013.01)

(58) Field of Classification Search
CPC ..... G03G 9/0825; G03G 9/09307; G03G 9/09708
USPC ..... 430/110.2
See application file for complete search history.

(56) References Cited

U.S. PATENT DOCUMENTS

| | | | | |
|---|---|---|---|---|
| 4,943,505 | A | 7/1990 | Aoki et al. | |
| 9,329,513 | B2 * | 5/2016 | Kobayashi | G03G 9/09725 |
| 9,423,713 | B2 * | 8/2016 | Takatsuna | G03G 9/09716 |
| 2015/0153664 | A1 * | 6/2015 | Kobayashi | G03G 9/09725 430/108.22 |
| 2015/0293465 | A1 * | 10/2015 | Takatsuna | G03G 9/09716 430/108.22 |

FOREIGN PATENT DOCUMENTS

| | | |
|---|---|---|
| JP | 60-186854 | 9/1985 |
| JP | 2005-202133 | 7/2005 |

* cited by examiner

*Primary Examiner* — Mark A Chapman
(74) *Attorney, Agent, or Firm* — Studebaker & Brackett PC

(57) ABSTRACT

An electrostatic latent image developing toner includes a plurality of toner particles, The toner particles each include a toner mother particle and a plurality of external additive particles. The toner mother particle contains at least a hinder resin and a colorant. The external additive particles each include a first particle, a plurality of second particles disposed at a surface of the first particle, and the coat layer coating the first particle having the second particles.

10 Claims, 1 Drawing Sheet

ELECTROSTATIC LATENT IMAGE DEVELOPING TONER AND EXTERNAL ADDITIVE

INCORPORATION BY REFERENCE

The present application claims priority under 35 U.S.C. §119 to Japanese Patent Application No. 2015-131181, filed on Jun. 30, 2015. The contents of this application are incorporated herein by reference in their entirety.

BACKGROUND

The present disclosure relates to an electrostatic latent image developing toner and an external additive.

An electrostatic latent image developing toner includes a plurality of toner particles. The toner particles for example have an external additive. One example of the external additive is a fine power of a polymer obtained through soap-free polymerization. Another example of the external additive is composite resin particles, which are resin particles including inorganic particles.

SUMMARY

An electrostatic latent image developing toner according to an aspect of the present disclosure includes a plurality of toner particles. The toner particles each include a toner mother particle and a plurality of external additive particles. The toner mother particle contains at least a binder resin and a colorant. The external additive particles each include a first particle, a plurality of second particles disposed at a surface of the first particle, and a coat layer coating the first particle having the second particles.

An external additive according to another aspect of the present disclosure includes a plurality of external additive particles. The external additive particles each include a first particle, a plurality of second particles disposed at a surface of the first particle, and a coat layer coating the first particle having the second particles.

DETAILED DESCRIPTION

The following describes an embodiment of the present disclosure. The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

An average value used herein refers to a number average value unless otherwise stated. When evaluation values (for example, values indicating shapes or properties) pertaining to powders (for example, an electrostatic latent image developing toner, toner particles, toner mother particles, and external additive particles to be described later) are given, such evaluation values are also number average values unless otherwise stated. A number average value is obtained by adding up values measured with respect to an appropriate number of measurement targets and dividing the sum by the nunber. The particle diameter of a powder is the diameter of a representative circle of a primary particle unless otherwise stated. The diameter of a representative circle is the diameter of a circle having the same area as a projection of the particle.

The present embodiment relates to an electrostatic latent image developing toner (hereinafter, may be referred to as a toner). The toner according to the present embodiment is for example used in an electrographic image forming apparatus for forming images.

Figure 1:
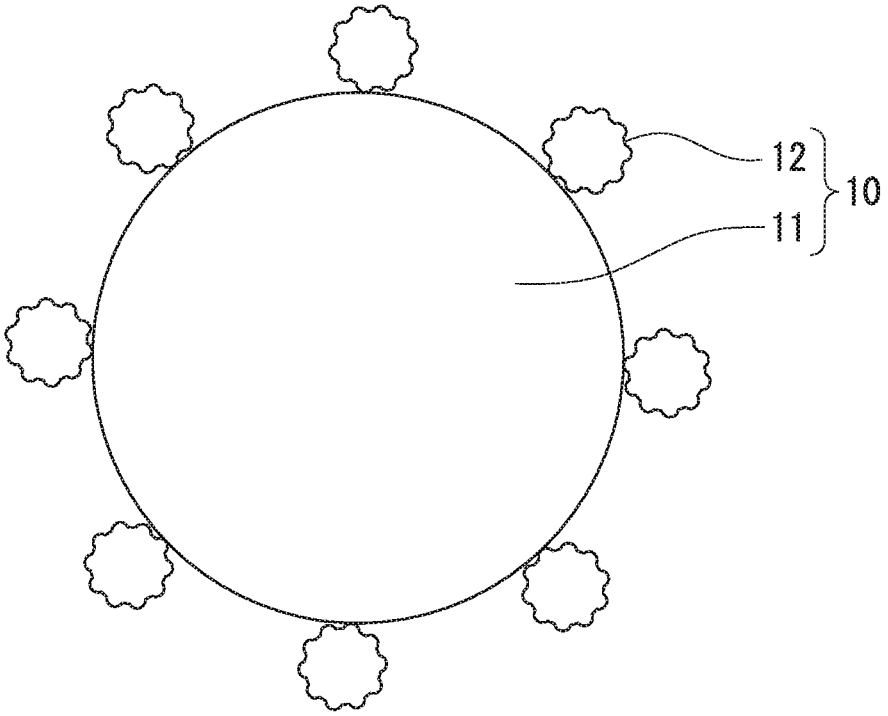
FIG. 1 is a cross-sectional view illustrating a toner particle included in an electrostatic latent image developing toner according to an embodiment of the present disclosure.

The toner according to the present embodiment includes a plurality of toner particles 10, The following describes the toner particles 10 with reference to FIG. 1. FIG. 1 is a cross-sectional view illustrating a toner particle 10 included in the toner according to the present embodiment.

The toner particle 10 includes the toner mother particle 11 and a plurality of the external additive particles 12. The external additive particles 12 adhere to the surface of the toner mother particle 11.

Toner mother particles may have been subjected to capsulation. The toner mother particles subjected to capsulation for example each have a core having the same structure and component as the toner mother particle 11 illustrated in FIG. 1 and a shell layer (capsule layer) disposed over a surface of the core.

<1. Toner Mother Particles>

The following describes the toner mother particles 11. The toner mother particles 11 contain at least a binder resin and a colorant. The toner mother particles 11 may contain at least one of a releasing agent, a charge control agent, and a magnetic powder as necessary. Non-essential components (for example, the releasing agent, the charge control agent, and the magnetic powder) may be omitted in accordance with the intended use of the toner.

The toner mother particles 11 preferably have a volume median diameter $D_{50}$ of at least 5 μm and no greater than 10 μm.

<1-1. Binder Resin>

No particular limitations are placed on the binder resin so long as the binder resin can be used for preparation of a toner. The binder resin is preferably a thermoplastic resin in terms of improving fixability of the toner. Examples of preferable thermoplastic resins include styrene-based resins, acrylic acid-based resins, styrene-acrylic acid-based resins, polyethylene resins, polypropylene resins, vinyl chloride resins, polyester resins, polyamide resins, urethane resins, polyvinyl alcohol resins, vinyl ether resins, N-vinyl compound-based. resins, and. styrene-butadiene resins. More preferably, the binder resin is a polyester resin in order to improve colorant dispersibility in the binder resin, toner chargeability, and toner fixability. The following describes the polyester resin.

The polyester resin can for example be obtained through condensation polymerization or condensation copolymerization of an alcohol and a carboxylic acid.

Examples of preferable alcohols that can be used in preparation of the polyester resin include diols, bisphenols, and tri- or higher-hydric alcohols.

Examples of diols that can be used include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Examples of bisphenols that can be used include bisphenol A, hydrogenated bisphenol A, bisphenol A ethylene oxide adduct, and bisphenol A propylene oxide adduct.

Examples of tri- or higher-hydric alcohols that can be used include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, tritnethylolpropane, and 1,3,5-trihydroxy tnethylbenzene.

Examples of carboxylic acids that can be used in synthesis of the polyester resin include di-, tri-, and higher-basic carboxylic acids. Examples of di-basic carboxylic acids that can be used include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid, and alkenyl succinic acid. Examples of alkyl succinic acids include n-butvlsuccinic acid, isobutylsuccinic acid, n-octylsuccinic acid, n-dodecylsuccinic acid, and isododecyisuccinic acid. Examples of alkenyl succinic acids include n-butenylsuccinic acid, isobutenylsuccinic acid, n-octenylsuccinic acid, n-dodecenylsuccinic acid, and isododecenylsuccinic acid.

Examples of tri- or higher-basic carboxylic acids that can be used include 1,2,4-benzenetricarboxylic acid (tritnellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

One alcohol may be used independently, or two or more alcohols may be used in combination. One carboxylic acid may be used independently, or two or more carboxylic acids may be used in combination. Furthermore, an ester-forming derivative of a carboxylic acid may be used. Examples of ester-forming derivatives that can be used include acid halide, acid anhydride, and lower alkyl ester. The term "lower alkyl" refers to an alkyl group having 1 to 6 carbon atoms.

The polyester resin preferably has a softening point of at least 80° C. and no greater than 150° C., and more preferably at least 90° C. and no greater than 140° C.

In a situation in which a polyester resin is used as the binder resin, the polyester resin content in the binder resin is preferably at least 70% by mass, more preferably at least 80% by MSS, particularly preferably at least 90% by mass, and most preferably 100% by mass.

In a situation in which a thermoplastic resin is used as the binder resin, one thermoplastic resin may be used independently, or two or more thermoplastic resins may be used in combination. A cross-linking agent or a thermosetting resin may be added to the thermoplastic resin. By introducing a cross-linking structure into the binder resin, preservability, shape retention, and durability of the toner are easily improved while also ensuring taxability of the toner.

A thermosetting resin can be used in combination with a thermoplastic resin as the binder resin. Examples of thermosetting resins that can be used include bisphenol A epoxy resins, hydrogenated bisphenol A epoxy resins, novolac epoxy resins, polyalkylene ether type epoxy resins, cycloaliphatic epoxy resins, and cyanate-based resins. One themiosetting resin may he used independently, or two or more thermosetting resins may be used in combination.

The binder resin preferably has a glass transition point (Tg) of at least 30° C. and no greater than 60° C. As a result of the glass transition point of the binder resin being within the above-specified range, preservability, shape retention, and durability of the toner are easily improved while also maintaining excellent fixability of the toner.

The glass transition point of the binder resin can for example be obtained from a point of change of specific heat on a heat absorption curve that is plotted by measuring the binder resin using a differential scanning calorimeter (for example, "DSC-6220", product of Seiko Instruments Inc.). More specifically, 10 mg of a measurement sample (binder resin) is placed in an aluminum pan, and a heat absorption curve for the binder resin is plotted in a measurement temperature range of at least 25° C. and no greater than 200° C. and with a heating rate of 10° C./minute using an empty aluminum pan as a reference. Then, the glass transition point of the binder resin is obtained based on the heat absorption curve.

<1-2. Colorant>

The colorant can be a known pigment or dye that matches the color of the toner The amount of the colorant is preferably at least 1 part by mass and no greater than 20 parts by mass relative to 100 parts by mass of the binder resin, and more preferably at least 3 parts by mass and no greater than 15 parts by mass.

(Black Colorant)

The toner mother particles 11 may contain a black colorant. The black colorant is for example a black pigment or a black dye. A specific example of the black pigment is carbon black. A black colorant that is adjusted to a black color using a yellow colorant, a magenta colorant, and a cyan colorant to be described later can be used (Non-Black Colorant)

The toner mother particles 11 may contain anon-block colorant, Examples of non-black colorants include a yellow colorant, a magenta colorant, and a cyan colorant.

Examples of yellow colorants that can be used include condensed azo compounds, isoindolinone compounds, anthraquinor e compounds, azo metal complexes, methine compounds, and arylamide compounds. Specific examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow Examples of magenta colorants that can be used include condensed azo compounds, diketopynolopyrrole compounds, a aquinc e compounds, quinacridone compounds, basic dye lake compounds, naphthol compounds, benzimidazolone compounds, thioindigo compounds, and perylene compounds. Specific examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants that can be used include copper phthalocyanine, copper phthalocyanine derivatives, anthraquinone compounds, and basic dye lake compounds. Specific examples of cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

<1-3. Releasing Agent>

The releasing agent is for example used in order to improve fixability of the toner or resistance of the toner to being offset. In order to improve fixability or offset resistance of the toner, the amount of the releasing agent is preferably at least 1 part by mass and no greater than 30 parts by mass relative to 100 parts by mass of the binder resin, and more preferably at least 2 parts by mass and no greater than 20 parts by mass.

Examples of releasing agents that can be used include aliphatic hydrocarbon waxes, oxides of aliphatic hydrocarbon waxes, plant waxes, animal waxes, mineral waxes, waxes having a fatty acid ester as a main component, and waxes in which a fatty acid ester is partially or fully deoxidized, Examples of aliphatic hydrocarbon waxes include ester wax, polyethylene wax (for example, low molecular weight polyethylene), polypropylene wax (for example, low molecular weight polypropylene), polyolefin copolymer, polyolefin wax, microcrystalline wax, paraffin wax, and Fischer-Tropsch wax, Examples of oxides of aliphatic hydrocarbon waxes include polyethylene oxide wax and block copolymer of polyethylene oxide. Examples of plant waxes include candelilla wax, carnauba wax. Japan wax, jojoba wax, and rice wax, Examples of animal waxes include beeswax, lanolin, and spermaceti, Examples of mineral waxes include ozokerite, ceresin, and petrolatum. Examples of waxes having a fatty acid ester as a main component include montanic acid ester wax and castor wax. Examples of waxes in which a fatty acid ester is partially or fully deoxidized include deoxidized carnauba wax.

One releasing agent may be used independently, or two or more easing agents may be used in combination.

<1-4. Charge Control Agent>

The charge control agent is for example used in order to improve charge stability or a charge rise characteristic of the toner. The charge control agent is also used in order to obtain a toner having excellent durability and stability. The charge rise characteristic is an indicator as to whether the toner can be charged to a specific charge level in a short period of time.

A positively chargeable charge control agent is preferably used in a situation in which development is performed using a positively chamed toner. A negatively chargeable charge control agent is preferably used in a situation in which development is performed using a negatively charged toner. However, it is not essential to use a charge control agent if sufficient chargeability of the toner can be ensured without the charge control agent.

Examples of positively chargeable charge control agents that can be used include azine compounds, direct dyes made from azine compounds, nigrosine compounds, acid dyes made from nigrosine compounds, metal salts of naphthenic acids, metal salts of higher fatty acids, alkoxvlated amines, and alkylamides.

Examples of azine compounds include pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quina.zoline, and quinoxaline.

Examples of direct dyes made from azine compounds include Azine Fast Red FC, Azine Fast Red 12BK, Azine Violet BO, Azine Brown 3G, Azine Light Brown GR, Azine Dark Green BH/C, Azine Deep Black EW and Azine Deep Black 3RL.

Examples of nigrosine compounds include nigrosine, nigrosine salts, and nigrosine derivatives. Examples of acid dyes made from nigrosine compounds include Nigrosine BK, Nigrosine NB, and Nigrosine Z. Examples of quaternary ammonium salts include benzyldecylhexylmethyl ammonium chloride and decyltrimethyl ammonium chloride.

A resin having a quaternary amtnoniuin salt, a salt of carboxylic acid, or a carboxyl group may be used as a positively chargeable charge control agent. Nigrosine compounds are particularly preferable for achieving rapid charge rise.

Examples of negatively chargeable charge control agents that can be used include organic metal complexes or organic metal salts. Examples of organic metal complexes include: acetylacetone metal complexes such as aluminum acetylacetonate and iron(II) acetylacetonate; and salicylic acid-based metal complexes such as 3,5-di-tert-butylsalicylic acid chromium. Examples of organic metal salts include salicylic acid-based metal salts. In particular, a salicylic acid-based metal complex and a salicylic acid-based metal salt are preferable.

The amount of the charge control agent is preferably at least 1 part by mass and no greater than 15 parts by mass relative to 100 parts by mass of the toner overall. One charge control agent may be used independently, or two or more charge control agents may be used in combination.

<1-5. Magnetic Powder>

Examples of magnetic powders that can be used include iron, ferromagnetic metals, alloys including either or both of iron and a ferromagnetic metal, compounds including either or both of iron and a ferromagnetic metal, ferromagnetic alloys subjected to ferromagnetization, and chromium dioxide, Examples of iron include ferrite and magnetite. Examples of ferromagnetic metals include cobalt and nickel. The ferromagnetization is for example heat treatment.

Preferably, the magnetic powder has a particle diameter of at least 0.1 μm and no greater than 1.0 μm. A magnetic powder having a particle diameter within the above-specified range tends to be homgeneously dispersed in the binder resin.

<1-6. Method for Preparing Toner Mother Particles>

Examples of methods for preparing the toner mother particles 11 include an aggregation method and a pulverization method. Toner mother particles 11 having high roundness can be prepared more easily by the aggregation method than by the pulverization method. Furthermore, toner mother particles 11 having uniform shape and partide diameter can be prepared easily by the aggregation method. On the other hand, the pulverization method is simpler than the aggregation method in producing toner mother particles 11.

(Pulverization Method)

The following describes an example of the pulverization method. First, a binder resin, a colorant, and a component that is contained as necessary (for example, a charge control agent, a releasing agent, and a magnetic powder) are mixed. Next, the resultant mixture is melted and kneaded. Next, the resultant melt-knead is pulverized and classified. Through the above, toner mother particles 11 having a desired particle diameter are obtained, (Aggregation Method)

The following describes an example of the aggregation method. First, fine particles of a binder resin, fine particles of a colorant, and fine particles of components that are contained as necessary (for example, a charge control agent, a releasing agent, and a magnetic powder) are caused to aggregate in an aqueous medium to form aggregated particles. Next, the resultant aggregated particles are heated to cause components contained in the aggregated particles to coalesce. Through the above, the toner mother particles 11 are obtained.

<2. External Additive>

Figure 2:
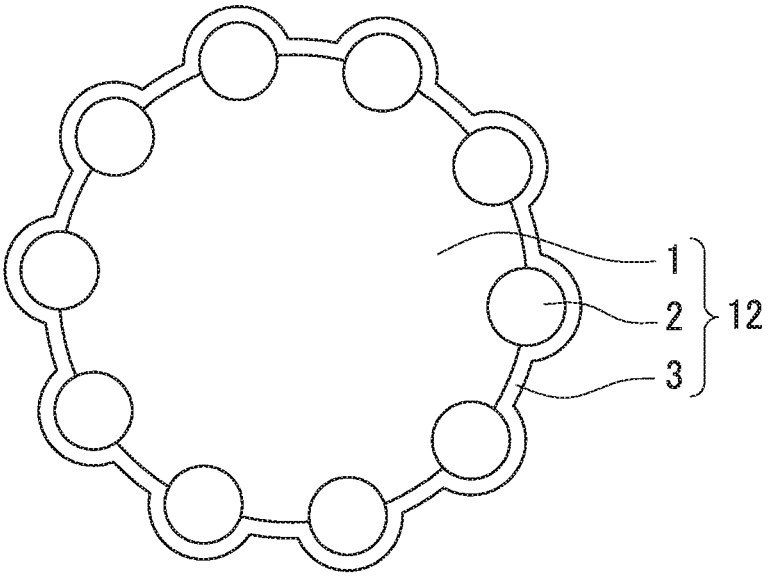
FIG. 2 is a cross-sectional view illustrating an external additive particle that is added to the toner particle in the electrostatic latent image developing toner according to the embodiment of the present disclosure.

The external additive particles 12 included in an external additive are caused to adhere to the toner mother particles 11 to give the toner particles 10. The external additive includes a plurality of external additive particles 12. The following describes the external additive particles 12 with reference to FIG. 2. FIG. 2 is a cross-sectional view illustrating an external additive particle 12 that is added to the toner particles 10 in the toner according to the present embodiment.

<2-1. External Additive Particles>

The external additive particles 12 are for example used as spacer particles. The spacer particles are for example used in order to reduce stress (friction) due to direct contact of the toner particles 10 with one another. The spacer particles are for example used also in order to improve fluidity, aggregability, and durability of the toner. The external additive particles 12 each have the first particle 1, the plurality of second particles 2, and the coat layer 3. The second particles 2 are disposed at the surface of the first particle 1. The second particles 2 are disposed so as to be in contact with the surface of the first particle 1. The coat layer 3 coats (i.e., is disposed over) the first particle 1 having the second particles 2. Preferably, the coat layer 3 directly coats the first particle 1 having the second particles 2. The coat layer 3 coats the first particle 1 and the second particles 2. The second particles 2 are located between (at an interface between) the first particle and the coat layer 3.

Since the external additive particle 12 has the above-described specific structure, the second particles 2 tend to be restricted from detaching from the first particle 1 and from being embedded within the first particle 1. As a result, the surface profile (roughness) of the external additive particle 12 is easily maintained. Because of the surface profile, the external additive particle 12 tends not to detach from a toner mother particle 11.

Preferably, the second particles 2 are disposed at the surface of the first particle 1 such that part of each of the second particles 2 is left outside the surface of the first particle 1. That is, the second particles 2 are preferably embedded in the surface of the first particle 1 such that the second particles 2 are not completely embedded within the surface of the first particle 1, The second particles 2 preferably protrude from the surface of the first particle 1 with the coat layer 3 coating (i.e., being disposed over) the second particles 2. More preferably, the second particles 2 protrude from the surface of the first particle 1 with the coat layer 3 directly coating the second particles 2. Thus, the surface of each external additive particle 12 is easily roughened, and the external additive particles 12 are easily restricted from detaching from the toner mother particles 11. Furthermore, the second particles 2 are preferably embedded in the surface of the first particle 1 such that each second particle 2 is not entirely left outside the first particle 1. As a result, the second particles 2 tend not to detach from the first particle 1 during formation of the coat layer 3.

Whether or not part of each of the second particles 2 is left outside the surface of the first particle 1 is for example confirmed through observation of the surface of the external additive particle 12 at a magnification of ×50,000 using a scanning electron microscope (SEM) ("JSM-6700F", product of JEOL Ltd.). Whether or not the second particles 2 protrude from the surface of the first particle 1 with the coat layer 3 coating the second particles 2 is also confirmed by the same method.

The external additive particles 12 are preferably contained in an amount of at least 0.1 parts by mass and no greater than 10 parts by mass relative to 100 parts by mass of the toner mother particles, and more preferably at least 0.1 parts by mass and no greater than 5 parts by mass in order that the external additive particles 12 favorably function as the spacer particles.

The external additive particles 12 preferably have a volume median diameter $D_{50}$ of at least 50 nm and no greater than 200 nm in order that the external additive particles 12 favorably function as the spacer particles.

<2-1-1. First Particles>

The first particles 1 are for example resin particles. Examples of resin particles that can be used include styrene resin particles styrene-acrylic resin particles, vinyl resin particles, polyester resin particles, urethane resin particles, acrylonitrile resin particles, and acrylamide resin particles.

The styrene resin particles are for example obtained through polymerization or copolymerization of at least one styrene-based monomer. Examples of styrene-based monomers that can be used include styrene, α-methylstyrene, p-chlorostyrene, 3,4-dichlorostvrene, p-phenylstyrene, p-ethylstyrene, 2,4-dimethylstyrene, and p-tert-butylstyrene.

The styrene-acrylic resin particles are for example obtained through copolymerization of at least one styrene-based monomer and at least one acrylic acid-based monomer. Examples of styrene-based monomers that can be used for forming the styrene-acrylic resin particles include the styrene-based monomers that can be used for forming the styrene resin particles. Examples of acrylic acid-based monomers that can be used include methacrylic acid, alkyl methacrylates, acrylic acid, and alkyl acrylates. Examples of alkyl methacrylates include methyl methacrylate, ethyl methacrylate, n-butyl methacrylate, isopropyl methacrylate, and 2-ethylhexyl methacrylate. Examples of alkyl acrylates that can be used include methyl acrylate, ethyl acrylate, iso-propyl acrylate, n-butyl acrylate, tert-butyl acrylate, isobutyl acrylate, n-octyl acrylate, and 2-ethylhexyl acrylate, The vinyl resin particles are for example obtained through polymerization or copolymerization of at least one vinyl compound. Examples of vinyl compounds that can be used include olefins, vinyl halides, vinyl esters, vinyl ethers, vinyl ketones, N-vinyl compounds, vinylnaphthalene, and vinyl pyridines. Examples of olefins include ethylene, propylene, and isobutylene. Examples of vinyl halides include vinyl chloride, vinylidene chloride, vinyl bromide, vinyl fluoride, and vinylidene fluoride. Examples of vinyl esters include vinyl propionate and vinyl acetate. Examples of vinyl ethers include vinyl methyl ether and vinyl ethyl ether. Examples of vinyl ketones include vinyl methyl ketone, vinyl ethyl ketone, and vinyl hexyl ketone, Examples of N-vinyl compounds include N-vinylcarbazole, N-vinyl indole, and N-vinyl pyrrolidone.

The polyester resin particles are for example obtained through condensation polymerization or condensation copolymerization of at least one alcohol and at least or e carboxylic acid. Examples of alcohols that can be used for forming the polyester resin particles include the alcohols that can be used for synthesis of the polyester resin for the binder resin. Examples of carboxylic acids that can be used for forming the polyester resin particles include the carboxylic acids that can be used for synthesis of the polyester resin for the binder resin.

The urethane resin particles are for example obtained through condensation of a diisocyanate and a diol compound.

The acrylonitrile resin particles are for example obtained through polymerization or copolymerization of at least one of acrylonitrile and methacrylonitrile.

The acrylamide resin particles are for example obtained through polymerization or copolymerization of at least one acrylamide-based monomer. Examples of acrylamide-based monomers include acrylamide, N-butyl acrylamide, N,N-dibutyl acrylamide, methacrylamide, N-butyl methacrylamide, and N-octadecyl acrylamide.

The first particles 1 preferably have a volume median diameter $D_{50}$ of at least 50 nm and no greater than 190 nm, and more preferably at least 70 nm and no greater than 140 nm. As a result of the first particles 1 having a volume median diameter $D_{50}$ within the above-specified range, the second particles 2 are easily caused to adhere to the first particles 1.

<2-1-2. Second Particles>

As a result of the second particles disposed at the surface of each first particle 1, the surface of the external additive particles 12 tends to be roughened. As a result of the surface of the external additive particles 12 being roughened, the external additive particles 12 tend not to detach from the toner mother particles 11.

The second particles 2 are for example inorganic particles. Examples of inorganic particles that can be used include inorganic oxide particles, Specific examples of inorganic oxide particles include silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The surface of the second particles 2 may be hydrophobized with a hydrophobization agent. In a situation in which the coat layers 3 of the external additive particles 12 are hydrophobic, the hydrophobization of the surface of the second particles 2 may be omitted. Examples of hydrophobization agents include a titanate coupling agent, a silane coupling agent, a fatty acid, a metal salt of a fatty acid, and silicone oil.

The second particles 2 preferably have a smaller volume median diameter $D_{50}$ than the first particles 1. The second particles 2 preferably have a volume median diameter $D_{50}$ of at least 10 nm and less than 50 nm, and more preferably at least 10 nm and no greater than 28 nm. As a result of the second particles 2 having a volume median diameter $D_{50}$ within the above-specified range, the surface profile (roughness) of the external additives 12 tends to be the one that prevents the external additive particles 12 from easily detaching from the toner mother particles 11.

The second particles 2 are preferably contained in the external additive particles 12 in an amount of at least 0.01 parts by mass and no greater than 10 parts by mass relative to 100 parts by mass of the first particles 1, and more preferably at least 0.1 parts by mass and no greater than 5 parts by mass.

<2-1-3. Coat Layers>

As a result of the external additive particles 12 each having the coat layer 3, the second particles 2 are easily restricted from detaching from the first particles 1 and from being embedded within each of the first particles 1. Consequently, the surface profile (roughness) of the external additive particles 12 is easily maintained. Thus, the external additive particles 12 tend not to detach from the toner mother particles 11. In a situation in which the coat layers 3 are hydrophobic, the external additive particles 12 can be hydrophobized. through formation of the coat layers 3.

As described above, the first particles 1 may for example be resin particles, and the second particles 2 may for example be inorganic particles. Inorganic particles tend to be harder than resin particles. In the case of a toner with external additive particles having resin particles and inorganic particles disposed at the surface of each of the resin particles, therefore, the inorganic particles typically tend to detach from the resin particles and tend to be embedded within each of the resin particles during continuous image formation using the toner. However, the external additive particles 12 have the coat layers 3, and therefore the second particles 2 are easily restricted from detaching from the first particles 1 and from being embedded within each of the first particles 1. The external additive particles 12 therefore tend not to detach from the toner mother particles 11 even if the first particles 1 are resin particles and the second particles 2 are inorganic particles.

If the first particles 1 are particles that tend to affect the charge of the toner particles 10 (for example inorganic particles, and more specifically silica particles) and the external additive particles 12 including such first particles 1 detach from the toner mother particles 11 of the toner particles 10, a difference tends to be created between the charge of toner particles 10 from which the external additive particles 12 have detached and the charge of toner particles 10 from which the external additive particles 12 have not detached. However, since the external additive particles 12 have the coat layers 3, the external additive particles 12 tend not to detach from the toner mother particles 11, Consequently, such a charge difference between toner particles 10 tends not to be created, and the toner including the toner particles 10 tends to have charge stability. As a result of the toner having charge stability, the image density of an image formed using the toner is easily improved, and occurrence of fogging in the image is easily restricted.

The coat layers 3 preferably contain a thermosetting resin. The thermosetting resin tends to have high heat resistance. As a result of the coat layers 3 containing a thermosetting resin, therefore, the external additive particles 12 tend not to melt on an image bearing member even if the external additive particles 12 detach from the toner mother particles II. Furthermore, as a result of the coat layers 3 containing a thermosetting resin, the hardness of the surface of the external additive particles 12 is increased, so that the toner particles 10 having the external additive particles 12 readily polish the surface of the image bearing member. Thus, an image formed using the toner tends not to have a prime mark shaped streak referred to as "at dash mark". It is thought that ease of toner cleaning on the image bearing member is therefore improved.

Examples of thermosetting resins that can be used include phenolic resins (for example, resole resin) and nitrogen-containing thermosetting resins to be described later. Examples of phenolic resins that can be used include a polycondensate of phenol and formaldehyde. The phenolic resin is for example formed through polycondensation of phenol and formaldehyde in the presence of an alkali catalyst.

The thermosetting resin is preferably contained in the coat layers 3 in an amount of at least 80% by mass relative to mass of the coat layers 3, more preferably at least 90% by mass, and particularly preferably 100% by mass.

More preferably, the coat layers 3 contain a nitrogen-containing thermosetting resin from among thermosetting resins. The nitrogen-containing thermosetting resin is a thermosetting resin that contains nitrogen atoms in the chemical structure thereof.

The nitrogen-containing thermosetting resin tends to be positively charged as containing nitrogen atoms. In a situation in which the toner is a positively chargeable toner, therefore, the toner tends to have stable positive charge as a result of the coat layers 3 containing a nitrogen-containing thermosetting resin. Furthermore, as a result of the second particles 2 being coated by the coat layers 3, the toner including the toner particles 10 having the external additive particles 12 is readily charged to a desired positive charge even if the external additive particles 12 have second particles 2 that tend to be negatively charged (for example inorganic particles, and more specifically silica particles). Furthermore, the nitrogen-containing thermosetting resin tends to be highly hydrophobic. As a result of the coat layers 3 containing a nitrogen-containing thermosetting resin, therefore, the toner tends to have stable positive charge even in a high humidity environment (for example, a relative humidity of 80%).

The nitrogen-containing thermosetting resin is preferably contained in the coat layers 3 in an amount of at least 80% by mass relative to mass of the coat layers 3, more preferably at least 90% by mass, and particularly preferably 100% by mass.

Examples of nitrogen-containing thermosetting resins that can be contained in the coat layers 3 include amino resins, melamine resins, urea resins, polyamide resins, polyimide resins, polyamide-imide resins, aniline resins, guanamine resins, and urethane resins. In particular, a melamine resin or a urea resin is preferable in order to favorably maintain the surface profile (roughness) of the external additive particles 12.

The melamine resin has a complex three-dimensional network structure, and therefore tends to have high hardness and high durability. Furthermore, the melamine resin is polymerized through dehydration condensation, and therefore the melamine resin readily bonds to silica. In a situation in which the coat layers 3 contain a melamine resin and the second particles are silica particles, therefore, the second particles 2 and the coat layers 3 tend to strongly bond to one another.

The melamine resin is for example a polycondensate of melamine and formaldehyde. The melamine resin is for example formed by the following method.

First, an addition reaction of melamine and formaldehyde is carried out. The addition reaction yields a precursor (methylol melamine) of the melamine resin. Next, a condensation reaction (cross-linking reaction) between molecules of methylol melamine is carried out. Through the condensation reaction, amino groups on different methylol melamine molecules bond to one another via methylene groups. The above process yields the melamine resin.

The methylol melamine can be altered in terms of solubility in water by changing the type or number of functional groups of the methylol melamine. It is therefore relatively easy to cause polymerization of methylol melamine in an aqueous medium.

The urea resin is for example a polycondensate of urea and formaldehyde. The urea resin is for example formed in the same manner as in the method for forming the melamine resin except that urea is used instead of melamine.

The thermosetting resin is preferably dissolved in a specific solvent (for example, an organic solvent or an aqueous solvent). As a result of the thermosetting resin being dissolved in a specific solvent, the coat layers 3 are readily formed in a coat layer formation process to be described later.

Since the second particles 2 are easily restricted from detaching from the first particles 1 and from being embedded within each of the first particles 1, the coat layers 3 are preferably contained in the external additive particles 12 in an amount of at least 1 part by mass and no greater than 10 parts by mass relative to 30 parts by mass in total of the first particles 1 and the second particles 2.

Since the second particles 2 are easily restricted from detaching from the first particles 1 and from being embedded within each of the first particles 1, the coat layers 3 preferably have a thickness of at least 1 nm and no greater than 10 nm.

<2-2. Method for Preparing External Additive>

The following describes an example of a method for preparing the external additive particles 12. Preferably, a large amount of external additive particles 12 are formed at a time in terms of efficiency of formation of the external additive particles 12.

(Mixing Process)

In a mixing process, the first particles 1 and the second particles 2 are for example mixed using a mixer (for example, an FM mixer or a Nauta mixer (registered Japanese trademark)). Through the above, the first particles 1 each having the second particles 2 disposed at the surface thereof are obtained. Mixing of the first particles 1 and the second particles 2 are preferably performed under conditions that prevent the second particles 2 from being completely embedded within each of the first particles 1. Such conditions are for example a rotation speed of the mixer of 3,500 rpm and a mixing time of 3 minutes. Mixing performed ander such conditions allows part of each of the second particles 2 to be left outside the surface of each of the first particles 1.

(Coat Layer Formation Process)

In the coat layer formation process, the first particles 1 each having the second particles 2 disposed at the surface thereof are coated by the coat layers 3. The coat layers 3 are formed by a reaction method or a solution application method. The reaction method involves causing a reaction (polymerization) of a material of the coat layers 3 in a dispersion of the first particles 1 each having the second particles 2 disposed at the surface thereof to form the coat layers 3 on the first particles 1 each having the second particles 2 disposed at the surface thereof. The solution application method involves applying a solution of the material of the coat layers 3 to the first particles 1 each having the second particles 2 disposed at the surface thereof and subsequently removing the solvent of the solution to form the coat layers 3 on the first particles 1 each having the second particles 2 disposed at the surface thereof.

The following describes an example (reaction method) of the method for preparing the external additive particles 12. First, a material (for example, a monomer for forming a thermosetting resin) of the coat layers 3 is dissolved in an aqueous medium. Next, the first particles 1 each haying the second particles 2 disposed at the surface thereof are dispersed in the solution of the material of the coat layers 3 to give a dispersion of the first particles 1 each having the second particles 2 disposed at the surface thereof. Next, the dispersion is heated to cause a reaction between the material of the coat layers 3 and the first particles 1 each having the second particles 2 disposed at the surface thereof in the dispersion. Next, the dispersion is cooled to room temperature. Through the above, a dispersion of the external additive particles 12 is obtained. The external additive particles 12 each include the first particle 1, the second particles 2 disposed at the surface of the first particle 1, and the coat layer 3 coating the first particle 1 having the second particles 2.

For causing the reaction between the material of the coat layers 3 and the first particles 1 each having the second particles 2 disposed at the surface thereof, for example, the dispersion may be stirred using a stirring device (for example, "HIVIS MIX (registered Japanese trademark), product of PRIMIX Corporation).

In a situation in which the coat layers 3 contain a thermosetting resin, the dispersion of the first particles 1 each having the second particles 2 disposed at the surface ti ereof is preferably adjusted to a pH of at least 2 and no greater than 6 prior to formation of the coat layers 3. Adjustment of the dispersion to a more acidic pH than neutral (pH 7) can promote formation of the coat layers 3.

Furthermore, in a situation in which the coat layers 3 contain a thermosetting resin, the coat layers 3 are preferably formed at a temperature of at least 60° C. and no greater than 100° C. Causing the reaction of the material of the coat layers 3 at a temperature of at least 60° C. and no greater than 100° C. can promote formation of the coat layers 3.

(Washing Process)

In a washing process, the external additive particles 12 are washed. The external additive particles 2 are for example washed with water. Examples of preferable methods for washing the external additive particles 12 include the following first and second methods. The first method involves filtering the dispersion of the external additive particles 12, collecting the external additive particles 12 as a wet cake, and washing the wet cake of the external additive particles 12 using water. The second method involves causing the external additive particles 12 to sediment in the depression of the external additive particles 12, replacing the supernatant with water, and then redispersing the external additive particles 12 in the water.

A filtrate of the filtration of the dispersion of the external additive particles 12 according to the first method preferably has an electrical conductivity of no greater than 10 μS/cm. The electrical conductivity is for example measured using an electrical conductivity meter "Hotiba COND METER ES-51", product of HORIBA, Ltd.

(Drying Process)

After the washing process, the external additive particles 12 are dried. An example of a preferable method for drying the external additive particles 12 involves using a dryer such as a spray dryer, a fluidized bed dryer, a vacuum freeze dryer, or a reduced pressure dryer.

<2-3. Optional External Additive>

The toner particles 10 may include an external additive (optional external additive) other than the external additive including the external additive particles 12 as necessary. The optional external additive is for example used in order to improve fluidity of the toner or in order for the toner to polish the image bearing member more readily.

Examples of optional external additives that can be used include silica and metal oxides (for example, alumina, titanium oxide, magnesium oxide, zinc oxide, strontium titanate, and barium titanate).

The optional external additive preferably has a number average particle diameter of at least 1 nm and no greater than 1 μm, and more preferably at least 1 nm and no greater than 50 nm. The amount of the optional external additive is preferably at least 0.5 parts by mass and no greater than 10 parts by mass relative to 100 parts by mass of the toner mother particles.

<2-4. Method for Adding External Additive>

The toner particles 10 are produced through adhesion (external addition) of the external additive particles 12 to the surface of the toner mother particles 11. An example of a preferable external addition method involves mixing the toner mother particles 11 and the external additive particles 12 using a mixer (for example, an FM mixer, product of Nippon Coke & Engineering Co., Ltd. or a Nauta mixer (registered Japanese trademark), product of Hosokawa. Micron Corporation) under conditions that prevent the external additive particles 12 from being embedded within each of the toner mother particles 11.

<2-5. Two-Component Developer>

The toner according to the present embodiment may be mixed with a carrier to be used in a two-component developer. A magnetic carrier is preferably used in preparation of the two-component developer.

A carrier in which carrier cores are coated by a resin may be used as the carrier A resin carrier in which carrier cores are dispersed in a resin may be used as the carrier.

Examples of carrier cores include: particles of iron, oxidized iron, reduced iron, magnetite, copper, silicon steel, ferrite, nickel, or cobalt; particles of an alloy of any of the above materials metal (specific examples include manganese, magnesium, zinc, and aluminum); particles of iron-nickel alloy; particles of iron-cobalt alloy, particles of a ceramic; and particles of a high-dielectric substance. Examples of ceramics include titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate. Examples of high-dielectric substances include ammonium dihydroaen phosphate, potassium dihydrogen phosphate, and Rochelle salt. One type of the carrier cores listed above may be used independently, or two or more types of the carrier cores listed above may be used in combination.

Examples of resins that can be used to coat the carrier cores include acrylic acid-based polymers, styrene-based. polymers, styrene-acrylic acid-based copolymers, olefin polymers, polyvinyl chloride, polyvinyl acetate, poly carbonates, cellulose resins, polyester resins, unsaturated polyester resins, polya.mide resins, urethane resins, epoxy resins, silicone resins, fluororesins, phenolic resins, xylene resins, diallyl phthalate resins, polyacetal resins, and amino resins. Examples of olefin polymers include polyethylene, chlorinated polyethylene, and polypropylene. Examples of fluororesins incl tide polytetrafluoroethylene, polychlorotrifluoroethylene, and polyvinylidene fluoride. One of the resins listed above may be used independently, or two or more of the resins may be used in combination.

The carrier preferably has a particle diameter of at least 20 μm and no greater than 120 μm, and more preferably at least 25 μm and no greater than 80 μm. The particle diameter of the carrier is for example measured using an electron microscope.

In a situation in which the toner is used in a two-component developer, the toner is preferably contained in an amount of at least 3% by mass and no greater than 20% by mass relative to mass of the two-component developer, and more preferably at least 5% by mass and no greater than 15% by mass.

The two-component developer is for example prepared by a method involving mixing the toner and the carrier using a mixer such as a ball mill.

Through the above, the toner according to the present embodiment has been described with reference to FIGS. 1 and 2. The toner according to the present embodiment can maintain the surface profile of the external additive particles 12 and restrict the external additive particles 12 from detaching from the toner mother particles 11.

EXAMPLES

The following describes examples of the present disclosure. However, the present disclosure is not limited to the examples. The following first describes methods for measuring physical properties that are used in the examples.

(Volume Median Diameter and Number Average Primary Particle Diameter)

The volume median diameter $D_{50}$ and the number average primary particle diameter of first particles, second particles, external additive particles, and toner mother particles were measured using a precision particle size distribution analyzer ("Coulter Counter Multisizer 3", product of Beckman Coulter, Inc.), The volume median diameter $D_{50}$ is a volume-based median diameter measured by a Coulter Counter method.

(Glass Transition Point)

The glass transition point of styrene-acrylic resin particles (sample) was measured as described below. A heat absorption curve for the sample was plotted using a differential scanning calorimeter (DSC) ("DSC-6220", product of Seiko Instruments Inc). The sample in an amount of 10 mg was placed in an aluminum pan. An empty aluminum pan was used as a reference. A heat absorption curve for the sample was plotted in a measurement temperature range of at least 25° C. and no greater than 200° C. and with a heating rate of 10° C./minute. The glass transition point of the sample was obtained based on the heat absorption curve (more specifically, a point of change of specific heat of the sample).

(Softening Point)

The softening point of styrene-acrylic resin particles (sample) was measured as described below. The sample was set in a capillary rheometer ("CFT-500D", product of Shimadzu Corporation). Melt-flow of 1 $cm^3$ of the sample was caused under conditions of a die pore diameter of 1 mm, a plunger load of 20 $kg/cm^2$, and a heating rate of 6° C./minute. Thus, an S-shaped curve of temperature (° C.)/stroke (mm) was plotted. The softening point of the sample was read from the S-shaped curve. More specifically, in the S-shaped curve, $S_1$ represented a maximum stroke value and $S_2$ represented a base line stroke value at low temperatures. The softening point of the sample was a temperature on the S-shaped curve corresponding to a stroke value of $(S_1+S_2)/2$. Thus, the softening. point of the sample was determined.

(Thickness of Coat Layers)

The thickness of coat layers of external additive particles was measured as described below. The external additive particles were observed, and cross-sectional TEM images thereof were captured using a transmission electron microscope (TEM) ("JSM-7600F", product of JEOL Ltd.). The captured TEM images were analyzed using commercially available image-analyzing software ("WinROOF", product of Mitani Corporation). More specifically, two straight lines that perpendicularly intersect at approximately the center of a cross-section of one external additive particle were drawn and lengths of four segments where the two straight lines intersect the coat layer were measured. An average value of the measured lengths of the four segments was taken to be the thickness of the coat layer of the one external additive particle. The above-described coat layer thickness measurement was performed on 10 external additive particles. A thickness of the coat layer of each of the 10 external additive particles was determined. The stun of the thicknesses of the coat layers of the 10 external additive particles was divided by 10. The thus obtained value was taken to be the thickness of the coat layers of the external additive particles.

In a situation in which the coat layer was too thin, and therefore an interface between the coat layer and the first particle or any of the second particles was unclear in a TEM image, TEM and electron energy loss spectroscopy (EELS) were used in combination to perform mapping in a TEM image of an element that is characteristic of the coat layer (for example, nitrogen). Thus, the interface between the coat layer and the first particle or the second particle was clarified to measure the thickness of the coat layer.

(Electrical Conductivity)

The electrical conductivity of a filtrate was measured using an electrical conductivity meter ("Horiba COND METER ES-51", product of HORMA, Ltd.).

<Preparation of External Additive Particles>

External additive particles A to F were prepared as described below (External Additive Particles A)

Styrene-acrylic resin particles ("FINE SPHERE (registered Japanese trademark) FS-102", product of Nippon Paint Co., Ltd., volume median diameter ($D_{50}$): 0.1 μm) were used as first particles. Dry silica particles ("AEROSIL (registered Japanese trademark) REA90", product of Nippon Aerosil Co., Ltd., BET specific surface area: 90 $m^2/g$, volume median diameter ($D_{50}$): 20 nm) were used as second particles. An FM mixer ("FM-10B", product of Nippon Coke & Engineering Co., Ltd.) was used to mix 100 g of the first particles and 1 g of the second particles at a rotation speed of 3,500 rpm for 3 minutes. Through the above, the second particles were caused to adhere to the surface of the first particles.

Subsequently, the first particles having the second particles adhering thereto were each coated by a coat layer. More specifically, a three-necked flask having a capacity of 1 L was set up in a water bath set at a water temperature of 30° C. Next, 500 mL of ion exchanged water was poured into the flask. The ion exchanged water in the flask was adjusted to pH 4 through addition of hydrochloric acid. Next, 5 mL of an aqueous solution of a hexamethylol melamine prepolymer ("MIRBANE (registered Japanese trademark) resin SM-607", product of Showa Denko K. K., solid concentration: 80% by mass) was added to and mixed with the flask content. Next, 30 g of the first particles having the second particles adhering thereto were added to the flask content, followed by stirring. Subsequently, 500 mL of ion exchanged water was added to the flask content. The temperature of the flask content was raised to 70° C. at a rate of 1° C./minute under stirring. The flask content was stirred for 2 hours with the temperature thereof maintained at 70° C. Subsequently, the flask content was neutralized to pH 7. The flask content was filtered to collect a solid. The filtrate of the filtration of the flask content had an electrical conductivity of 4 μS/cm. The collected solid was washed and dried. Through the above, external additive particles A were obtained.

The external additive particles A each had a coat layer (melarni.ne resin) coating each of the first particles (styrene-acrylic resin particles) having the second particles (silica particles) adhering thereto. The external additive particles A had a volume median diameter $D_{50}$ of 130 nm and a coat layer thickness of 3 nm.

The surface of the external additive particles A was observed at a magnification of ×50,000 using an SEM ("ISM-6700F", product of JEOL Ltd.) and an image thereof was captured. The captured image confirmed that the second particles were disposed at the surface of each of the first particles of the external additive particles A such that part of each second particle was left outside the surface of the first particle. That is, part of each second particle was embedded in the surface of the first particle such that each second particle was not completely embedded within the surface of the first particle. The captured image also confirmed that the second particles protruded from the surface of the first particle with the coat layer coating the second particles.

(External Additive Particles B)

Styrene-acrylic resin particles ("FINE SPHERE (registered Japanese trademark) FS-102", product of Nippon Paint Co., Ltd., volume median diameter ($D_{50}$): 0.1 μm) were used as first particles. Dry silica particles ("AEROSIL (registered Japanese trademark) REA90", product of Nippon Aerosil Co., Ltd., BET specific surface area: 90 $m^2/g$, volume median diameter ($D_{50}$): 20 nm) were used as second particles. An FM mixer ("FM-10B", product of Nippon Coke & Engineering Co., Ltd.) was used to mix 100 g of the first particles and 1 g of the second particles at a rotation speed of 3,500 rpm for 3 minutes. Through the above, the second particles were caused to adhere to the surface of the first particles.

Subsequently, the first particles having the second particles adhering thereto were coated by coat layers. More specifically, a three-necked flask having a capacity of 1 L was set up in a water bath set at a water temperature of 30° C. Next, 500 mL of ion exchanged water was poured into the flask. The ion exchanged water in the flask was adjusted to pH 4 through addition of hydrochloric acid. Next, 5 mL of an aqueous solution of methylol urea ("MIRBANE (registered Japanese trademark) resin SU-100", product of Showa Denko K. K., solid concentration: 80% by mass was added to and mixed with the flask content. Next, 30 g of the first particles having the second particles adhering thereto were added to the flask content, followed by stirring. Subsequently, 500 mL of ion exchanged water was added to the flask content. The temperature of the flask content was raised to 70° C. at a rate of 1° C./minute under stirring. The flask content was stirred for 2 hours with the temperature thereof maintained at 70° C.. Subsequently, the flask content was neutralized to pH 7. The flask content was filtered to collect a solid. The filtrate of the filtration of the flask content had an electrical conductivity of 4 μS/cm. The collected solid was washed and dried. Through the above, external additive particles B were obtained.

The external additive particles B each had a coat layer (urea resin) coating each of the first particles styrene-acrylic resin particles) having the second particles (silica particles) adhering thereto. The external additive particles B had a volume median diameter $D_{50}$ of 130 nm and a coat layer thickness of 3 nm.

The surface of the external additive particles B was observed at a magnification of ×50,000 using an SEM ("JSM-6700F", product of JEOL Ltd.) and an image thereof was captured. The captured image confirmed that the second particles were disposed at the surface of each of the first particles of the external additive particles B such that part of each second particle was left outside the surface of the first particle. That is, part of each second particle was embedded in the surface of the first particle such that each second particle was not completely embedded within the surface of the first particle. The captured image also confirmed that the second particles protruded from the surface of the first particle with the coat layer coating the second particles.

(External Additive Particles C)

Styrene-acrylic resin particles ("FINE SPHERE (registered Japanese trademark) FS-102", product of Nippon Paint Co., Ltd., volume median diameter ($D_{50}$): 0.1 um) were used as first particles. Dry silica particles ("AEROSIL (registered Japanese trademark) REA90", product of Nippon Aerosil Co., Ltd., BET specific surface area: 90 $m^2/g$, volume median diameter ($D_{50}$): 20 nm) were used as second particles. An FM mixer ("FM-10B", product of Nippon Coke & Engineering Co., Ltd.) was used to mix 100 g of the first particles and 1 g of the second particles at a rotation speed of 3,500 rpm for 3 minutes. Through the above, the second particles were caused to adhere to the surface of the first particles.

Subsequently, the first particles having the second particles adhering thereto were coated by coat layers. First, a 40% by mass aqueous solution of an alkaline resole phenolic resin was prepared as a material for forming coat layers. More specifically, 960 g of phenol and 600 g of a 40% by mass aqueous sodium hydroxide solution (0.6 equivalents relative to 1 equivalent of phenolic hydroxyl groups) were put in a four-necked reaction flask. Next, 1305 g of 45% by mass formalin was continuously dripped into the flask while the flask content was being stirred. After dripping, the internal temperature of the flask was raised to 70° C., and the flask content was reacted at 70° C. for 3 hours. After completion of the reaction, 664 g of water was added into the flask. Through the above, a 40% by mass aqueous solution of an alkaline resole phenolic resin was obtained.

Subsequently, a three-necked flask having a capacity of 1 L was set up in a water bath set at a water temperature of 30° C. Next, 500 mL of ion exchanged water was poured into the flask. The ion exchanged water in the flask was adjusted to pH 9 through addition of sodium hydroxide (NaOH). The thus prepared 40% by mass aqueous solution of an alkaline resole phenolic resin in an amount of 10 mL was added to and mixed with the flask content. Next, 30 g of the first particles having the second particles adhering thereto were added to the flask content, followed by stirring. Subsequently, 500 mL of ion exchanged water was added to the flask content. The temperature of the flask content was raised to 70° C. at a rate of 1° C./minute under stirring. The flask content was stirred for 2 hours with the temperature thereof maintained at 70° C. Subsequently, the flask content was neutralized to pH 7. The flask content was filtered to collect a solid, The filtrate of the filtration of the flask content had an electrical conductivity of 4 μS/cm. The collected solid was washed and dried. Through the above, external additive particles C were obtained.

The external additive particles C each had a coat layer (phenolic resin, more specifically resole resin) coating each of the first particles (styrene-acrylic resin particles) having the second particles (silica particles) adhering thereto. The external additive particles C had a volume median diameter $D_{50}$ of 130 nm and a coat layer thickness of 3 nm.

The surface of the external additive particles C was observed at a magnification of ×50,000 using an SEM ("JSM-6700F", product of JEOL Ltd.) and an image thereof was captured. The captured image confirmed that the second particles were disposed at the surface of each of the first particles of the external additive particles C such that part of each second particle was left outside the surface of the first particle. That is, part of each second particle was embedded in the surface of the first particle such that each second particle was not completely embedded within the surface of the first particle. The captured image also confirmed that the second particles protruded from the surface of the first particle with the coat layer coating the second particles.

(External Additive Particles D)

External additive particles D, which were resin particles, were prepared as described below. First, 450 mL of distilled water and 0.52 g of dodecylammonium chloride were put in a 1000 mL reaction vessel equipped with a stirrer, a cooling tube, and a temperature sensor. The reaction vessel content was heated to 80° C. under stirring under a flow of nitrogen. Next, 120 g of 1% by mass aqueous potassium peroxodisulfate solution was added to the reaction vessel content. Next, a liquid mixture of 15 g of butyl acrylate, 165 g of methyl methacrylate, and 3.6 g of n-octyl mercaptan was added to the reaction vessel content over 1.5 hours. The reaction vessel content was maintained for 2 hours. Thus, a polymerization reaction was completed. After completion of the polymerization reaction, the reaction vessel content was cooled. to room temperature to give a polymer dispersion. The polymer dispersion was dried to give a polymer (external additive particles D, which were resin particles). The thus obtained external additive particles D had a volume median diameter $D_{50}$ of 120 nm.

(External Additive Particles E)

External additive particles E. which were silica particles, were prepared as described below Finely pulverized silica. originating from silica stone, a carbon powder serving as a reductant, and water were put in a vessel. The vessel content was mixed to give a. raw material mixture. The thus obtained raw material mixture was thermally treated at approximately 1,800° C. using a furnace, Through the above, silicon dioxide ($SiO_2$) gas was produced from the raw material mixture. The silicon dioxide gas was subjected to forced cooling using cooling air (flow rate: 80 $m^3$/hour) to cause silica fine particles to deposit. The deposited silica fine particles were collected using a. bag filter to obtain silica fine particles. Aminopropylethoxysilane and a silicone oil were added to the silica fine particles. The resultant mixture was heated to give a solid. The solid was broken up using an FM mixer ("FM-10B", product of Nippon Coke & Engineering Co., Ltd.). Through the above, external additive particles E, which were silica particles, were obtained. The external additive particles E had a number average primary particle diameter of 100 nm.

(External Additive Particles F)

External additive particles F including first particles and second particles (including no coat layers were prepared as described below. Styrene-acrylic resin particles ("FINE SPHERE (registered Japanese trademark) FS-102", product of Nippon Paint Co., Ltd., volume median diameter ($D_{50}$): 0.1 μm) were used as first particles. Dry silica particles ("AEROSIL (registered Japanese trademark) REA90", product of Nippon Aerosil Co., Ltd., BET specific suiface area: 90 $m^2$/g, volume median diameter ($D_{50}$): 20 nm) were used as second particles. An FM mixer ("FM-10B", product of Nippon Coke 84 Engineering Co., Ltd.) was used to mix 100 g of the first particles and 1 g of the second particles at a rotation speed of 3,500 rpm for 3 minutes. Through the above, the second particles were caused to adhere to the surface of the first particles. Thus, external additive particles F were obtained. The thus obtained external additive particles F had a volume median diameter $D_{50}$ of 122 nm.

<Preparation of Toner>

With respect to each of the external additive particles A, B, C, D, E, and F, a toner was prepared using the external additive particles, toner mother particles, and an optional external additive.

(Preparation of Toner Mother Particles)

The following binder resin, colorant, charge control agent, and releasing agent were used as raw materials of toner mother particles.

Binder resin: polyester resin ("Polyester (registered Japanese trademark) HP-313", product of Nippon Synthetic Chemical Industry Co., Ltd.)

Colorant: carbon black ("MA-100", product of Mitsubishi Chemical Corporation)

Charge control agent: BONTRON (registered Japanese trademark) N-71 (product of Orient Chemical Industries Co., Ltd.)

Releasing agent: camauba wax (product of TOA KASEI CO., LTD.)

An FM mixer ("FM-10B", product of Nippon Coke & Engineering Co., Ltd.) was used to mix 87.0 parts by mass of the binder resin, 8.0 parts by mass of the colorant, 2.0 parts by mass of the charge control agent, and 3.0 parts by mass of the releasing agent to give a mixture. The mixture was melt-kneaded using a twin screw extruder ("TEM-26SS", product of Toshiba Machine Co. Ltd.). The resultant melt-knead was coarsely pulverized using a pulverizer ("Rotoplex (registered Japanese trademark) 16/8", product of Hosokawa Micron Corporation). The resultant coarsely pulverized product had a particle diameter of approximately 2 mm. The coarsely pulverized product was pulverized using a pulverizer ("Turbo Mill RS", product of Freund-Turbo Corporation). The pulverized product was classified using a classifier ("Elbow Jet EJ-LABO", product by Nittetsu Mining Co.). Through the above, toner mother particles were obtained. The thus obtained toner mother particles had a volume median diameter $D_{50}$ of 7.0 nm.

(External Addition)

With respect to each of the external additive particles A to F, 100.0 parts by mass of the toner mother particles, 1.0 part by mass of dry silica fine particles (positively chargeable silica fine particles "AEROSIL (registered Japanese trademark) REA200", product of Nippon Aerosil Co., Ltd.), 1.0 part by mass of titanium oxide particles (non-hydrophilic treated titanium oxide fine particles "MT-500B", product of TAYCA CORPORATION), and 1.0 part by mass of the external additive particles were mixed at a rotation speed of 3,500 rpm for 5 minutes using an FM mixer ("FM-10B", product of Nippon Coke & Engineering Co., Ltd.). Through the above, a toner was obtained.

<Preparation of Developer>

The thus obtained toner and a carrier were used to prepare a developer.

(Preparation of Carrier)

The carrier was prepared as described below. Ferrite particles ("F51-50", product of Powdertech Co., Ltd., particle diameter: 50 μm) were used as carrier cores. An epoxy resin ("jER (registered Japanese trademark) 1004", product of Mitsubishi Chemical Corporation) in an amount of 2 kg was dissolved in 20 L of acetone. Next, 100 g of &ethylene triamine and 150 g of phthalic anhydride were added to and mixed with the resultant solution. The resultant liquid mixture was sprayed onto IC) kg of the carrier cores using a flow coating device ("SPIR-A-FLOW (registered Japanese trademark) SFC-5", product of Freund Corporation) with hot air at 80° C. blowing into the device. As a result, the carrier cores were each coated by an uncured organic layer (flow layer). The carrier cores each coated with the uncured organic layer (flow layer) were heated at 180° C. for 1 hour using a drier. Through the above, the flow layer was cured. As a result, a carrier including carrier cores and resin layers (coat layers) coating the carrier cores was obtained.

(Preparation of Developer)

A ball mill was used to homogeneously mix 9 parts by mass of the toner and 100 parts by mass of the carrier. Through the above, a developer was obtained.

<Evaluations>

Using each of the developers obtained as described above, resistance of the toner in the developer to resulting in a. dash mark (dash mark resistance) was evaluated, Furthermore. BET specific surface area retention of the toner in the developer, charge distribution of the toner, image density (ID) of an image formed using the toner, and fogging density (FD) of an image formed using the toner were measured.

The developer and an evaluation apparatus were used to form an image continuously on a plurality of sheets of paper. More specifically, a color printer FS-C5016 (a printer including a positively chargeable organic photosensitive member as an image bearing member, product of KYOCERA Document Solutions Inc.) was used as the evaluation apparatus. Paper for both color and monochrome printing ("$C^2$", product of Fuji Xerox Co., Ltd.) was used as the paper. First, 150 g of the developer was loaded into a black-color developing unit in the evaluation apparatus. Toner for replenishment use was added into a black toner container in the evaluation apparatus. Next, an image I (coverage: 1%) was formed on 10,000 successive sheets of paper using the developer and the evaluation apparatus. Formation of the image I, formation of an image II to be described later, and observation and measurement to be described later were carried out under environmental conditions of a temperature of 23.5° C. and a relative humidity of 50%.

<Dash Mark Resistance>

The image I formed on the $10,000^{th}$ sheet was observed with unaided eyes to confirm presence or absence of a dash mark. Based on presence or absence of a dash mark, dash mark resistance of the toner was evaluated in accordance with the following standard. Note that the external additive particles that are more likely to detach from the toner mother particles and whose material is more likely to adhere to the surface of the image bearing member is more likely to result in a dash mark in an image to be formed, (Dash Mark Resistance Evaluation Standard)

G (Good): No dash mark present

P (Poor): Dash mark present

<BET Specific Surface Area Retention>

A BET specific surface area (A0) was measured for toner particles included in the toner that had not been used for formation of the image I, Next, after formation of the image I on the 10,000 sheets of paper, the developer was taken out from the developing unit of the evaluation apparatus, A BET specific surface area (A1) was measured for the toner particles included in the developer that was taken out. The BET specific surface area A0 and the BET specific surface area A1 of the toner particles were measured using a BET specific surface area measuring device (automatic specific surface area measuring device "Macsorb (registered Japanese trademark) HM MODEL-1208", product of Mountech CO., Ltd. A BET specific surface area retention was calculated from the measured BET specific surface area A0 and the measured BET specific surface area A1 in accordance with the formula: BET specific surface area retention [%]=100×A1/A0. The calculated BET specific surface area retention was evaluated in accordance with the following standard. Note that toner particles whose external additive particles are more likely to detach from toner mother particles, whose second particles are more likely to detach from each of first particles in the external additive particles, and whose second particles are more likely to be embedded within each of first particles in the external additive particles tend to have a lower BET specific surface area retention.

(BET Specific Surface Area Retention Evaluation Standard)

G (Good): A BET specific surface area of at least 85%

P (Poor): A BET specific surface area of less than 85%

<Charge Distribution Width>

After the image I was formed on 10,000 successive sheets of paper, the charge distribution width of the toner adhering to a development roller of the evaluation apparatus was determined. More specifically, 0.05 MPa of nitrogen gas was sprayed onto the development roller of the evaluation apparatus. Thus, the toner adhering to the development roller of the evaluation apparatus was let in a measurement section of a charge distribution and particle size analyzer ("E-spud Analyzer EST-3", product of Hosokawa Micron Corporation). In the measurement section, a voltage of +0.05 kV was applied to the toner. With respect to each of 3,000 toner particles included in the toner flowing through the measurement section, a charge Q and a particle diameter d of the toner particle was measured by laser Doppler electrophoresis. Based on the charge Q and the particle diameter d measured as described above, a charge per particle diameter ((/d) was calculated for each of the toner particles. The charge per particle diameter (Q/d) was plotted on a horizontal axis, and the number of toner particles having each charge per particle diameter (Q/d.) was plotted on a vertical axis. Thus, a charge distribution curve was obtained. A width of the thus obtained charge distribution curve at a value that is one quarter of the mde of the charge distribution of the toner was obtained. The width at the value that is one quarter of the mode of the charge distribution of the toner was evaluated in accordance with the following standard. Note that a smaller width at the value that is one quarter of the mode of the charge distribution of the toner indicates a toner having a sharper charge distribution.

(Charge Distribution Width Evaluation Standard)

G (Good): A width at the value that is one quarter of the mode of the charge distribution of less than 0.80 femtC/μm P (Poor): A width at the value that is one quarter of the mode of the charge distribution of at least 0.80 femtC/μm <Image Density and Fogging Density>

After the image I was formed on 10,000 successive sheets of paper, the image II was formed on 5,000 successive sheets of paper using the developer and the evaluation apparatus. The image II included an imaged portion haying a coverage of 8%, three solid image portions, and a blank paper portion. The image density of each of the three solid image portions of the image II formed on the $5,000^{th}$ sheet of paper was measured using a reflectance densitometer ("RD914" sold by SAKATA INX ENG CO., LTD.). The sum of image densities of the three solid image portions measured was divided by three to obtain an average value of the image densities. The thus obtained average was taken to be an evaluation value of the image density, The evaluation value of the image density was evaluated in accordance with the following evaluation standard.

(Image Density Evaluation Standard)

G (Good): An image density of at least 1.20

P (Poor): An image density of less than 1.20

Next, the image density of the blank paper portion of the image II formed on the $5,000^{th}$ sheet of paper was measured using a reflectance densitometer ("RD914" sold by SAKATA INX ENG CO., LTD.). A value obtained by subtracting an image density of the paper that has not been subjected to printing from the image density of the blank paper portion was taken to be a fogging density. The fogging density was evaluated in accordance with the following evaluation standard.

(Fogging Density Evaluation Standard)

G (Good): A fogging density of no greater than 0.007

P (Poor) A fogging density of greater than 0.007

Table 1 shows the BET specific surface area retention of the toners in the developers and the width at the value that is one quarter of the mode of the charge distribution of the toners. Table 1 also shows results of the dash mark resistance evaluation, the image density (ID) evaluation, and the fogging density (FD) evaluation of the images formed using the toners. In Table 1, the term "Q/d distribution width" refers to the width at the value that is one quarter of the de of the charge distribution of the toners.

The developer containing the toner having the external additive particles A was used in the evaluations as Example 1 in Table 1. The developer containing the toner having the external additive particles B was used in the evaluations as Example 2. The developer containing the toner having the external additive particles C was used in the evaluations as Example 3. The developer containing the toner having the external additive particles D was used in the evaluations as Comparative Example 1. The developer containing the toner having the external additive particles E was used in the evaluations as Comparative Example 2. The developer containing the toner having the external additive particles F was used in the evaluations as Comparative Example 3.

had charge stability, the images formed using the toners had a higher image density, and occurrence of fogging was restricted.

Furthermore, the toners including the toner particles having the external additive particles A to C showed excellent dash mark resistance. The results suggest that these toilers are excellent in terms of ease of toner cleaning on the surface of image bearing members of image forming apparatuses.

The toner including the toner particles having the external additive particles D had a low BET specific surface area retention. Since the external additive particles D are resin particles, the external additive particles D tend to have low surface roughness. It is therefore thought that the external additive particles D were easily detachable from the toner mother particles. Furthermore, the toner including the toner particles having the external additive particles D showed poor. dash mark resistance. Supposedly, this is because the external additive particles D were resin particles, and therefore the external additive particles D that had detached from the toner mother particles easily adhered to the surface of the image bearing member.

TABLE 1

| | External additive particles | | BET specific surface area retention | | Q/d distribution width | | Dash mark resistance | ID | | FD | |
|---|---|---|---|---|---|---|---|---|---|---|---|
| | Type | Coat layer | Value [%] | Evaluation | Value [femtC/μm] | Evaluation | Evaluation | Value | Evaluation | Value | Evaluation |
| Example 1 | A | Melamine resin | 90 | G | 0.65 | G | G | 1.25 | G | 0.003 | G |
| Example 2 | B | Urea resin | 87 | G | 0.67 | G | G | 1.23 | G | 0.004 | G |
| Example 3 | C | Phenolic resin | 86 | G | 0.70 | G | G | 1.22 | G | 0.005 | G |
| Comparative Example 1 | D | None | 77 | P | 0.78 | G | P | 1.23 | G | 0.007 | G |
| Comparative Example 2 | E | None | 79 | P | 0.92 | P | G | 1.13 | P | 0.015 | P |
| Comparative Example 3 | F | None | 82 | P | 0.83 | P | G | 1.20 | G | 0.009 | P |

The external additive particles A to C had the first particles, the second particles disposed at the surface of the first particles, and the coat layers coating the first particles having the second particles. The toners including the toner particles having the external additive panicles A to C therefore had a higher BET specific surface area retention as shown in Table 1. It is thought that the higher BET specific surface area retention was achieved because the second particles were restricted from detaching from the first particles in the external additive particles and from being embedded within each of the first particles in the external additive particles, and thus the surface profile (roughness) of the external additive particles was maintained. It is also thought that the higher BET specific surface area retention was achieved because the surface profile of the external additive particles was maintained, and thus detachment of the external additive particles from the toner mother particles was restricted., The toners including the toner particles having the external additive particles A to C had a smaller width at the value that is one quarter of the mode of the charge distribution (Q/d distribution width). The results indicate that these toners had charge stability. It is thought that since the toners The toner including the toner particles having the external additive particles E had a low BET specific surface area retention. Since the external additive particles E are silica particles, it is thought that the external additive particles E were easily detachable from the toner mother particles. The toners including the toner particles having the external additive particles F had a larger width at the value that is one quarter of the mode of the charge distribution (Q/d distribution width). Silica particles tend to affect the charge of toner particles. Therefore, it is thought that the external additive particles E (silica particles) that had detached from the toner mother particles created a difference in charge between toner particles from which the external additive particles E had detached and toner particles from which the external additive E had not detached. It is also thought that the difference in charge between toner particles caused fogging and reduction in the image density of the resultant image.

The toner including the toner particles having the external additive particles F had a low BET specific surface area retention. The external additive particles F included the first particles and the second particles but did not include the coat layers. Therefore, the second particles easily detached from the first particles and the second particles were easily embedded within each of the first particles during formation of the image on successive sheets of paper using the toner. It is thought that as a result, the surface roughness of the external additive particles F decreased and the external additive particles F easily detached from the toner mother particles. The toner including the toner particles having the external additive particles F had a larger width at the value that is one quarter of the mode of the charge distribution (Q/d distribution width). Silica particles tend to affect the charge of toner particles. Therefore, it is thought that the external additive particles F including the second particles (silica particles) that had detached from the toner mother particles created a difference in charge between toner particles from which the external additive particles F had detached and toner particles from which the external additive particles F had not detached. It is also thought that the difference in charge between toner particles caused fogging in the resultant image.

What is claimed is:

1. An electrostatic latent image developing toner comprising a plurality of toner particles, wherein the toner particles each include a toner mother particle and a plurality of external additive particles, the toner mother particle contains at least a binder resin and a colorant, the external additive particles each include:

a first particle;

a plurality of second particles disposed at a surface of the first particle; and a coat layer coating the first particle having the second particles, the first particle is a resin particle, the second particles are inorganic particles, and the second particles are located between the first particle and the coat layer.

2. The electrostatic latent image developing toner according to claim 1, wherein the second particles are disposed at the surface of the first particle such that part of each of the second particles is left outside the surface of the first particle.

3. The electrostatic latent image developing toner according to claim 1, wherein the second particles are disposed so as to be in contact with the surface of the first particle, and part of each of the second particles protrudes from the surface of the first particle with the coat layer coating the second particles.

4. The electrostatic latent image developing toner according to claim 1, wherein the second particles have a smaller volume median diameter than the first particle.

5. The electrostatic latent image developing toner according to claim 4, wherein the first particles have a volume median diameter of at least 70 nm and no greater than 140 nm.

6. The electrostatic latent image developing toner according to claim 4, wherein the second particles have a volume median diameter of at least 10 nm and no greater than 28 nm.

7. The electrostatic latent image developing toner according to claim 1, wherein the coat layer contains a thermosetting resin.

8. The electrostatic latent image developing toner according to claim 1, wherein the coat layer contains a nitrogen-containing thermosetting resin.

9. The electrostatic latent image developing toner according to claim 1, wherein the coat layer contains a phenolic resin.

10. An external additive comprising a plurality of external additive particles, wherein the external additive particles each include:

a first particle;

a plurality of second particles disposed at a surface of the first particle; and a coat layer coating the first particle having the second particles, the first particle is a resin particle, the second particles are inorganic particles, and the second particles are located between the first particle and the coat layer.

* * * * *